US011225974B2

(12) United States Patent
Sun et al.

(10) Patent No.: US 11,225,974 B2
(45) Date of Patent: Jan. 18, 2022

(54) FAN IMPELLER STRUCTURE

(71) Applicant: ASIA VITAL COMPONENTS CO., LTD., New Taipei (TW)

(72) Inventors: Sung-Wei Sun, New Taipei (TW); Ming-Che Lee, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 16/909,981

(22) Filed: Jun. 23, 2020

(65) Prior Publication Data

US 2021/0396243 A1 Dec. 23, 2021

(51) Int. Cl.

| | |
|---|---|
| ***F04D 29/30*** | (2006.01) |
| ***F04D 17/16*** | (2006.01) |
| ***F04D 29/28*** | (2006.01) |
| ***F04D 29/26*** | (2006.01) |

(52) U.S. Cl.

CPC ..... *F04D 29/281* (2013.01); *F04D 29/26* (2013.01); *F04D 29/30* (2013.01); *F04D 17/16* (2013.01)

(58) Field of Classification Search

CPC .... F04D 17/162; F04D 17/164; F04D 19/007; F04D 29/327

See application file for complete search history.

(56) References Cited

U.S. PATENT DOCUMENTS

| | | | | |
|---|---|---|---|---|
| 6,132,170 | A | 10/2000 | Horng | |
| 6,179,561 | B1 * | 1/2001 | Horng | F04D 25/0653 361/679.48 |
| 9,145,897 | B2 * | 9/2015 | Wu | F04D 29/30 |
| 9,206,808 | B2 * | 12/2015 | Yuan | F04D 17/16 |
| 9,267,507 | B2 * | 2/2016 | Wu | F04D 25/0613 |

FOREIGN PATENT DOCUMENTS

| | | | |
|---|---|---|---|
| CN | 2531148 | Y | 1/2003 |
| CN | 202280653 | U | 6/2012 |
| CN | 202732469 | U | 2/2013 |
| CN | 111043063 | A | 4/2020 |
| TW | I384130 | B1 | 2/2013 |
| TW | M510981 | U | 10/2015 |

* cited by examiner

*Primary Examiner* — Ninh H. Nguyen
*Assistant Examiner* — Jason G Davis
(74) *Attorney, Agent, or Firm* — Bradley J. Thorson; DeWitt LLP

(57) ABSTRACT

A fan impeller structure includes a hub and a blade set. The hub has a top wall and a circumferential wall extending from a circumference of the top wall. The blade set has multiple upper blades and multiple lower blades. The upper and lower blades are alternately arranged on the circumferential wall. Each upper and lower blade respectively has a first windward face and a second windward face which is extending in a different direction from the first windward face. The first windward face is disposed in such a direction as to face the rear edge of the lower blade on the lower side, while the second windward face is disposed in such a direction as to face the rear edge of the upper blade on the upper side.

7 Claims, 9 Drawing Sheets

FAN IMPELLER STRUCTURE

BACKGROUND OF THE INVENTION

1. Field of the Invention

The present invention relates generally to a fan impeller structure, and more particularly to a fan impeller structure, which can continuously pressurize the airflow to lower the noise.

2. Description of the Related Art

In the recent years, along with the development of electronic industries, the performances of the electronic devices have been continuously enhanced. The number of the chipsets in the electronic device is continuously increased and the operation is continuously speeded. As a result, the heat generated by the electronic device has become higher and higher. Therefore, the cooling fans are more and more widely applied to the internal electronic components of the electronic device.

Please refer to FIGS. 1A and 1B. The conventional centrifugal fan 1 includes an upper board 11, a bottom board 12, a wind inlet 13, a wind outlet 14 and a fan impeller structure 15. A peripheral wall 121 upward extends along an outer periphery of the bottom board 12. The upper board 11 is mated with the bottom board 12. The upper board 11, the bottom board 12 and the peripheral wall 121 together define a receiving space 16 for receiving the fan impeller structure 15. The bottom board 12 has a bearing cup 122. The fan impeller structure 15 has a shaft (not shown) rotatably disposed in the bearing cup 122. The wind inlet 13 is formed on the upper board 11, while the wind outlet 14 is formed on one side of the peripheral wall 121. The fan impeller structure 15 includes a hub 151 and multiple radial blades 152. The multiple radial blades 152 are annularly arranged on an outer circumference of the hub 151. Each radial blade 152 has a free end 1521, a fixed end 1522 directed to the center of the hub 151, a windward face 1523 and a lee face 1524 opposite to the windward face 1523. The fixed ends 1522 of the multiple radial blades 152 are securely connected on the outer circumference of the hub 151. The free ends 1521 of the blades 152 and the inner surface of the peripheral wall 121 define therebetween an airflow passage 157. The windward faces 1523 of the multiple radial blades 152 are directed in the same direction in parallel to each other. Each two radial blades 152 define therebetween a radial flow way 156. In operation of the centrifugal fan 1, the fan impeller structure 15 counterclockwise rotates and the multiple radial blades 152 will axially guide the external airflow 17 into the wind inlet 13 of the upper board 11. Accordingly, the airflow 17 flows from the fixed ends 1522 of the multiple radial blades 152 into the respective flow ways 156 to be pressurized. The pressurized airflow then radially flows out (throws out) from the free ends 1521 into the airflow passage 157. Then the airflow 17 flows along the inner surface of the peripheral wall 121 out of the radial wind outlet 14.

However, the conventional centrifugal fan 1 has a shortcoming. That is, in the conventional centrifugal fan 1, when the axial airflow 17 enters the flow ways 156 of the radial blades 152, the pressurization distance of the radial blades 152 for the airflow 17 is simply the short chord length of the radial blades 152. Therefore, the airflow 17 will be thrown out of the flow ways 156 before it is pressurized by the radial blades 152. Most of the airflow 17, which is not pressurized, will be directly thrown out from the free ends 1521 of the radial blades 152 to continuously hit the inner surface of the peripheral wall 121. Thereafter, the airflow 17 flows into the airflow passage 157 in a direction to the wind outlet 14 to flow out from the wind outlet 14. Due to the above reason, the conventional centrifugal fan 1 will make loud noise and severely vibrate so that the wind pressure and air volume of the fan can be hardly enhanced. Moreover, the motor of the conventional centrifugal fan 1 will consume much power. In addition, in the conventional centrifugal fan 1, the multiple radial blades 152 are densely arranged on the outer circumference of the hub 151. Therefore, in practice, it is hard to manufacture the mold for forming the fan impeller structure so that the cost is relatively high.

SUMMARY OF THE INVENTION

It is therefore a primary object of the present invention to provide a fan impeller structure, which can continuously pressurize the fluid (such as airflow) to lower the noise.

It is a further object of the present invention to provide the above fan impeller structure, in which the multiple upper and lower blades are alternately arranged on the circumferential wall of the hub so that the number of the blades can be reduced and it is easy to manufacture the mold. Therefore, the cost is lowered.

It is still a further object of the present invention to provide the above fan impeller structure having multiple upper and lower blades. The upper and lower blades are up and down alternately arranged on the circumferential wall of the hub. The fan impeller structure is applied to a centrifugal fan to enhance the wind pressure and air volume. Therefore, in operation, the vibration of the fan is reduced and the power consumption of the fan motor is reduced.

To achieve the above and other objects, the fan impeller structure of the present invention includes a hub and a blade set. The hub has a top wall and a circumferential wall extending from a circumference of the top wall. The blade set has multiple upper blades and multiple lower blades. The upper and lower blades are alternately arranged on the circumferential wall. Each upper blade has a first front edge and a first rear edge downward obliquely extending from the first front edge in a lengthwise direction of the upper blade to together define a first windward face. Each lower blade has a second front edge and a second rear edge upward obliquely extending from the second front edge in a lengthwise direction of the lower blade to together define a second windward face. The first windward face is disposed in such a direction as to face the second rear edge of the lower blade on the lower side, while the second windward face is disposed in such a direction as to face the first rear edge of the upper blade on the upper side. By means of the design of the fan impeller structure of the present invention, the fluid (such as airflow) is continuously boosted (pressurized) to effectively lower the noise, reduce the vibration and lower the cost. Also, the power (energy) consumption of the fan motor is reduced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
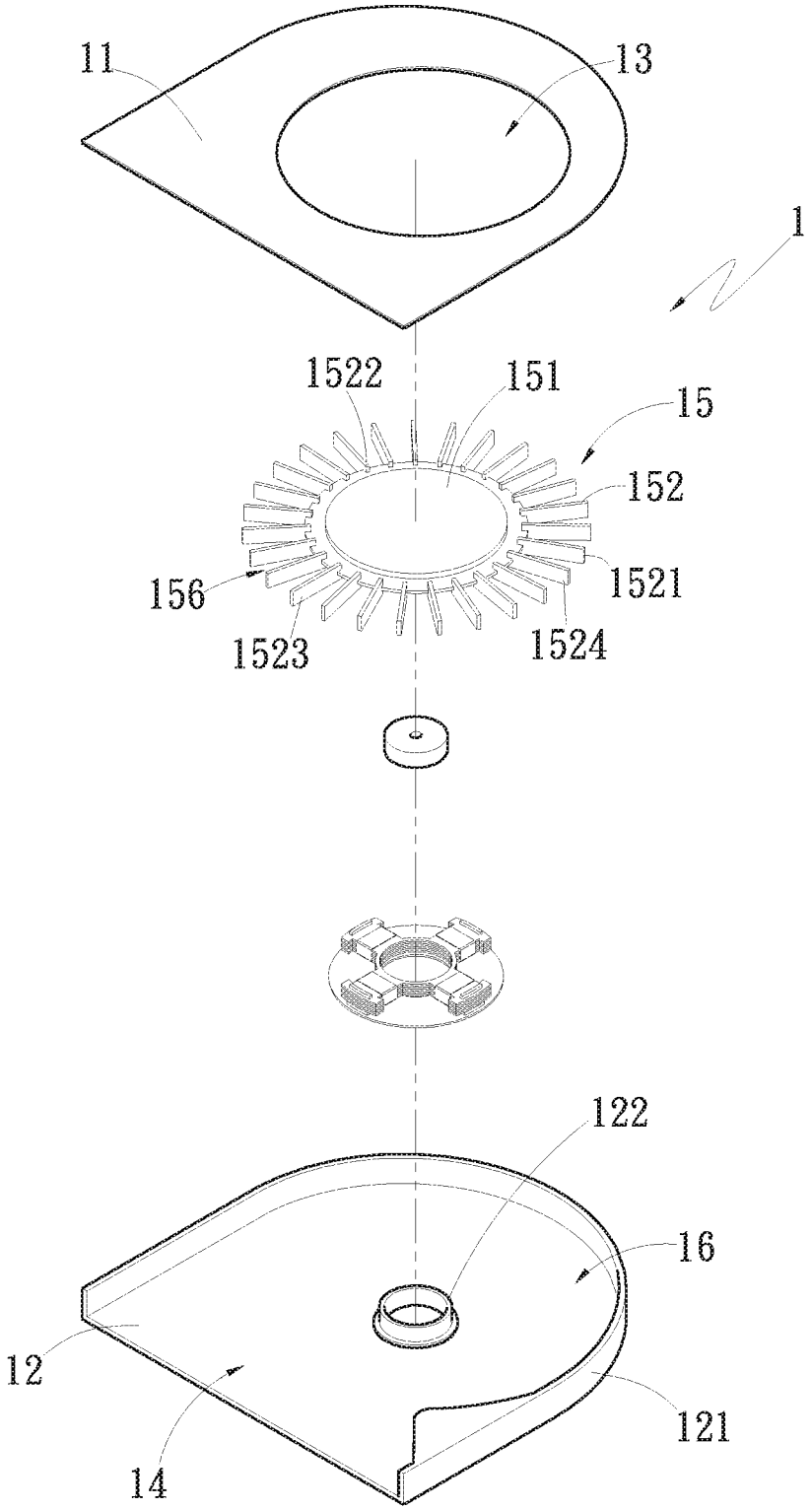
(PRIOR ART) Fig. 1A
FIG. 1A is a perspective exploded view of a conventional centrifugal fan.
Figure 1B:
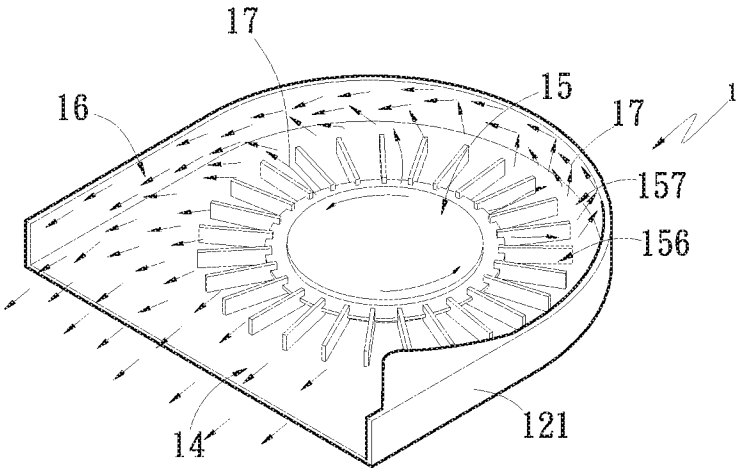
(PRIOR ART) Fig. 1B
FIG. 1B is a perspective assembled view of the conventional centrifugal fan, showing the airflow pattern thereof.
Figure 2A:
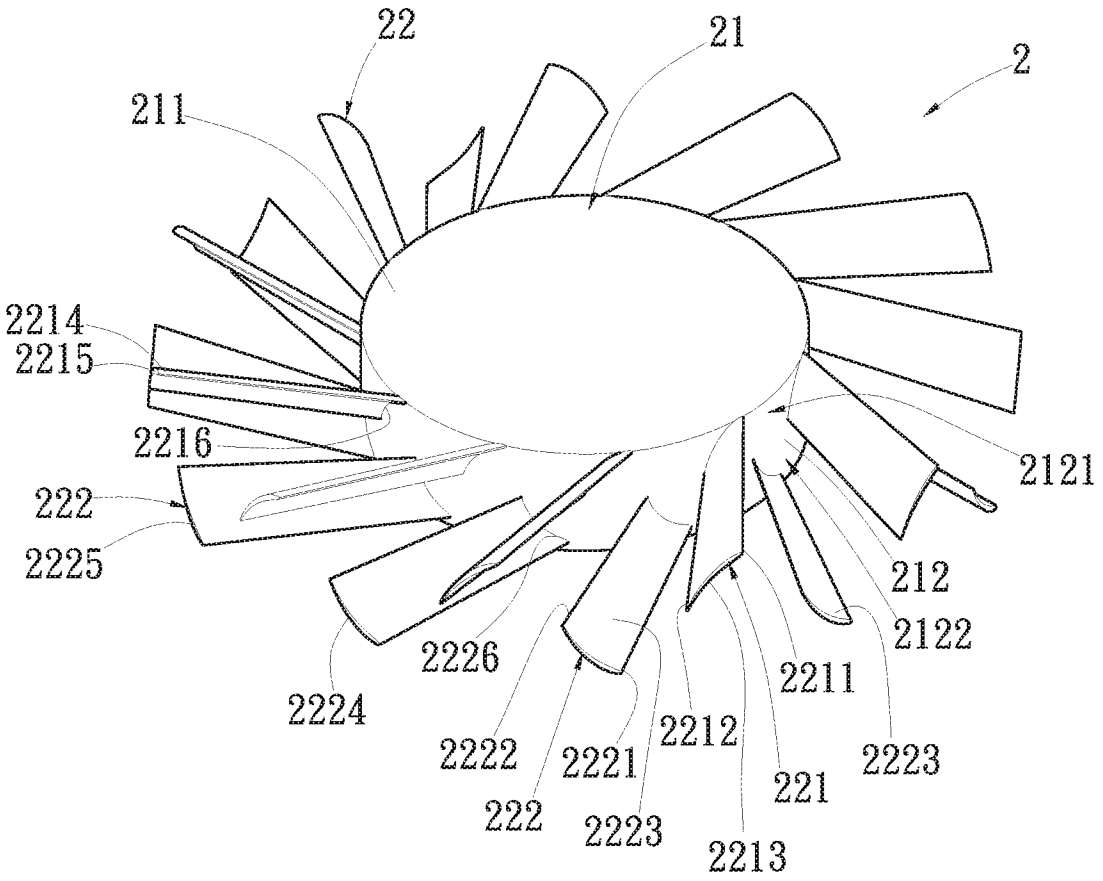
FIG. 2A is a perspective view of a first embodiment of the fan impeller structure of the present invention.
Figure 2B:
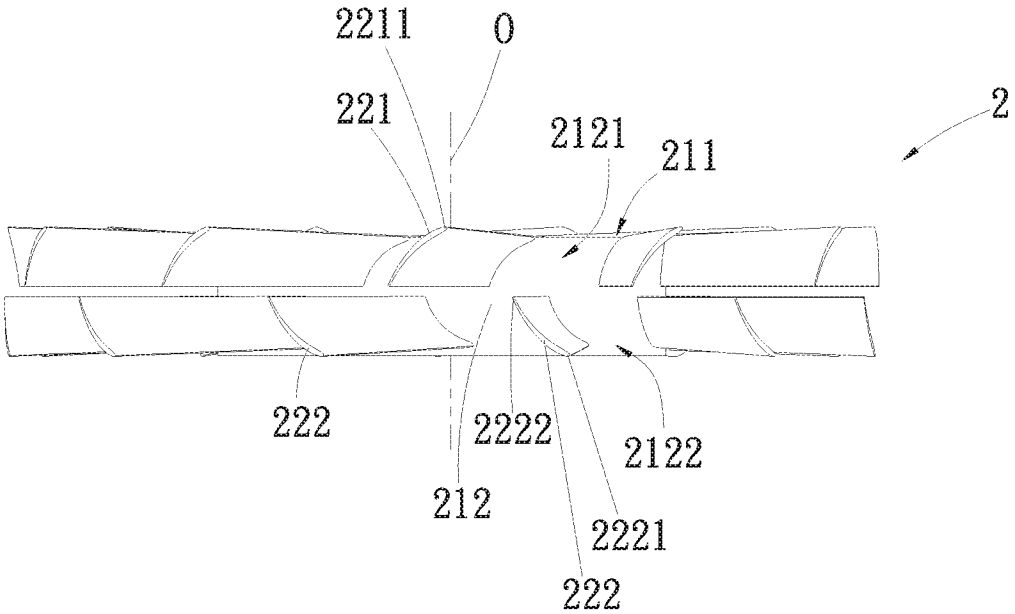
FIG. 2B is a side view according to FIG. 2A.
Figure 2C:
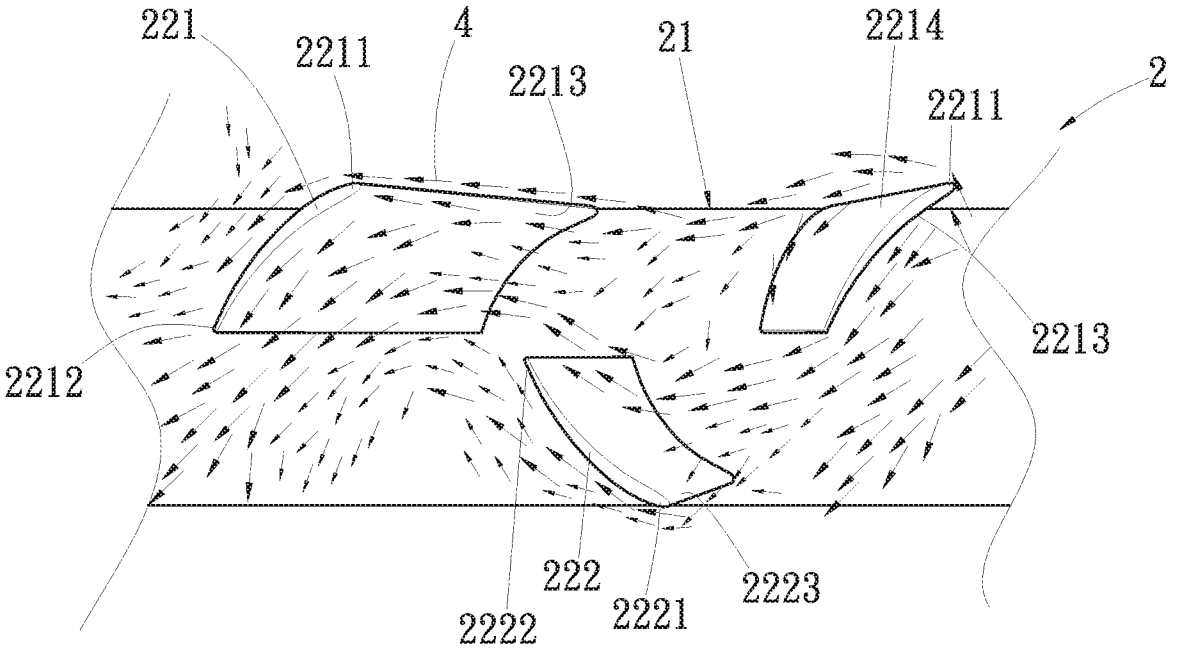
FIG. 2C is a side view of the first embodiment of the fan impeller structure of the present invention, showing the pattern of the airflow between the multiple upper and lower blades.

Please refer to FIGS. 2A to 2C. FIG. 2A is a perspective view of a first embodiment of the fan impeller structure of the present invention. FIG. 2B is a side view according to FIG. 2A. FIG. 2C is a side view of the first embodiment of the fan impeller structure of the present invention, showing the pattern of the airflow between the multiple upper and lower blades. As shown in the drawings, the fan impeller structure 2 of the present invention includes a hub 21 and a blade set 22. The hub 21 has a top wall 211 and a circumferential wall 212 extending from the circumference of the top wall 211. The circumferential wall 212 has an upper half section 2121 and a lower half section 2122. In this embodiment, the middle point between the top end and the bottom end of the circumferential wall 212 along the outer circumference of the hub 21 is, but not limited to, a borderline of the upper and lower half sections 2121, 2122. That is, the upper half section 2121 extends from the top end of the circumferential wall 212 to the middle point, while the lower half section 2122 extends from the middle point to the bottom end of the circumferential wall 212. The blade set 22 has multiple upper blades 221 and multiple lower blades 222. The upper and lower blades 221, 222 are alternately arranged on the circumferential wall 212. In this embodiment, the upper and lower blades 221, 222 are alternately arranged on the upper and lower half sections 2121, 2122. The multiple upper and lower blades 221, 222 are inclined from the central axis O of the hub 21. For example, the upper blades 221 are arranged on the upper half section 2121 by an inclination ranging from 30 degrees to 70 degrees and preferably 35 degrees to 50 degrees, while the lower blades 222 are arranged on the lower half section 2122 by an inclination ranging from 110 degrees to 155 degrees and preferably 120 degrees to 140 degrees.

The multiple upper and lower blades 221, 222 and the hub 21 are integrally formed by means of such as plastic injection molding or 3D printing. Certainly, in a modified embodiment, the multiple upper and lower blades 221, 222 and the hub 21 can be alternatively partially integrally formed and partially non-integrally formed. For example, the multiple upper blades 221 (or lower blades 222) are formed on the upper half section 2121 (or lower half section 2122) of the circumferential wall 212 of the hub 21 by means of plastic injection molding, while the multiple lower blades 222 (or upper blades 221) are connected with the lower half section 2122 (or upper half section 2121) of the circumferential wall 212 of the hub 21 by means of such as adhesion, insertion or welding. Still alternatively, the inner ends 2226 (or 2216) of the multiple lower blades 222 (or upper blades 221) proximal to the hub 21 are annularly connected with a hollow fitting collar, which is fitted on the lower half section 2122 (or upper half section 2121) of the circumferential wall 212 of the hub 21 and integrally connected therewith. In another modified embodiment, the multiple upper and lower blades 221, 222 and the hub 21 are all non-integrally formed. For example, the multiple upper and lower blades 221, 222 are connected with the upper and lower half sections 2121, 2122 of the circumferential wall 212 of the hub 21 by means of such as adhesion, insertion or welding.

Each upper blade 221 has a first front edge 2211 and a first rear edge 2212 in adjacency to the top wall 211. The first rear edge 2212 downward obliquely extends from the first front edge 2211 in the lengthwise direction of the upper blade 221 to together define a first windward face 2213 and a first lee face 2214 opposite to the first windward face 2213. The first windward face 2213 and the first lee face 2214 are respectively positioned on two sides of the upper blade 221. In the operation (such as counterclockwise rotation) of the fan impeller structure 2, a face (front face) of the fan impeller structure 2, which is directed in the rotational direction, is the first windward face 2213, while the other face (rear face) is the first lee face 2214. The first windward face 2213 is positioned in front of the first lee face 2214. In this embodiment, the first windward face 2213 and the first lee face 2214 are respectively such as a recessed curved face and a raised curved face, whereby the upper blade 221 has an arched form as a whole. In addition, the thickness of the upper blade 221 is, but not limited to, tapered in the extending direction of the arched form.

Each lower blade 222 has a second front edge 2221 and a second rear edge 2222 in adjacency to the bottom end of the circumferential wall 212. The second rear edge 2222 upward obliquely extends from the second front edge 2221 in the lengthwise direction of the lower blade 222 to together define a second windward face 2223 and a second lee face 2224 opposite to the second windward face 2223. The second windward face 2223 and the second lee face 2224 are respectively positioned on two sides of the lower blade 222. In this embodiment, the structure and shape (such as arched form) of the multiple lower blades 222 are identical to the structure and shape (such as arched form) of the multiple upper blades 221 and thus will not be redundantly described hereinafter. The upper and lower blades 221, 222 are different from each other in that the first windward face 2213 of each upper blade 221 is disposed in such a direction as to face the second rear edge 2222 of the corresponding lower blade 222 on the lower side, while the second windward face 2223 of each lower blade 222 is disposed in such a direction as to face the first rear edge 2212 of the corresponding upper blade 221 on the upper side. That is, as shown in FIGS. 2A and 2B, the first windward face 2213 of one of the multiple upper blades 221 is disposed on the upper half section 2121 in such a direction as to face the second rear edge 2222 of the lower blade 222 on the front oblique lower side, while the second windward face 2223 of the lower blade 222 on the front lower side is disposed on the lower half section 2122 in such a direction as to face the first rear edge 2212 of the upper blade 221 on the front oblique upper side. In addition, the first and second windward faces 2213, 2223 of the multiple upper and lower blades 221, 222 are directed in different directions without facing each other. Also, the first and second lee faces 2214, 2224 are directed in different directions. In a preferred embodiment, the shape of the upper blade 221 is identical to or different from the shape of the lower blade 222. For example, the upper blade 221 can have an arc (or arched) shape and the first windward face 2213 and the first lee face 2214 of the upper blade 221 are respectively a recessed arched face and a raised arched face. The lower blade 222 can have an arched (or arc) shape and the second windward face 2223 and the second lee face 2224 of the lower blade 222 are respectively a recessed curved face and a raised curved face. Alternatively, both the upper and lower blades 221, 222 have identical arc (or arched) shape.

In this embodiment, the thickness of the first front edge 2211 of each upper blade 221 is larger than the thickness of the first rear edge 2212, while the thickness of the second front edge 2221 of each lower blade 222 is larger than the thickness of the second rear edge 2222. In addition, the first front edge 2211 of each upper blade 221 is not coaxial with the second rear edge 2222 of the lower blade 222 on the front lower side, which faces the upper blade 221. Also, the first rear edge 2212 of each upper blade 221 is not coaxial with the second front edge 2221 of the corresponding lower blade 222 on the rear lower side. It can be seen from FIG. 2B that the first front edge 2211 and the first rear edge 2222 of each upper blade 221 are not overlapped with the second rear edge 2222 of the lower blade 222 on the front lower side and the second front edge 2221 of the lower blade 222 on the rear lower side respectively. In a modified embodiment, the first front edge 2211 of each upper blade 221 is coaxial with the second rear edge 2222 of the lower blade 222 on the front lower side, which faces the upper blade 221. Also, the first rear edge 2212 of each upper blade 221 is coaxial with the second front edge 2221 of the corresponding lower blade 222 on the rear lower side.

Accordingly, an axial fluid (airflow 4) is guided in by the first front edges 2211 of the multiple upper blades 221 of the fan impeller structure 2. Thereafter, the multiple upper blades 221 will pressurize the airflow 4 to downward throw out (flow out) along the first windward faces 2213 in a direction to the first rear edges 2212 at a constant speed. Then, the second front edges 2221 of the lower blades 222 on the rear lower side will catch the pressurized airflow 4 thrown from the upper blades 221. Thereafter, the lower blades 222 on the rear lower side will again pressurize the airflow 4 to upward throw out (flow out) along the second windward faces 2223 in a direction to the second rear edges 2222 at a constant speed. Then, the first front edges 2211 of the upper blades 221 on the rear upper side will catch the pressurized airflow 4 thrown from the lower blades 222 to again pressurize the airflow 4. Therefore, the airflow 4 is continuously up and down pressurized between the multiple upper and lower blades 221, 222 (as shown in FIG. 2C). In this case, the airflow 4 (fluid) is continuously boosted (pressurized) within the range between the multiple upper and lower blades 221, 222 to enhance the flow amount.

By means of the design of the fan impeller structure 2 of the present invention, the number of the blades can be effectively reduced and it is easy to manufacture the mold and the fan impeller structure 2. Therefore, the cost is effectively lowered.

Figure 3:
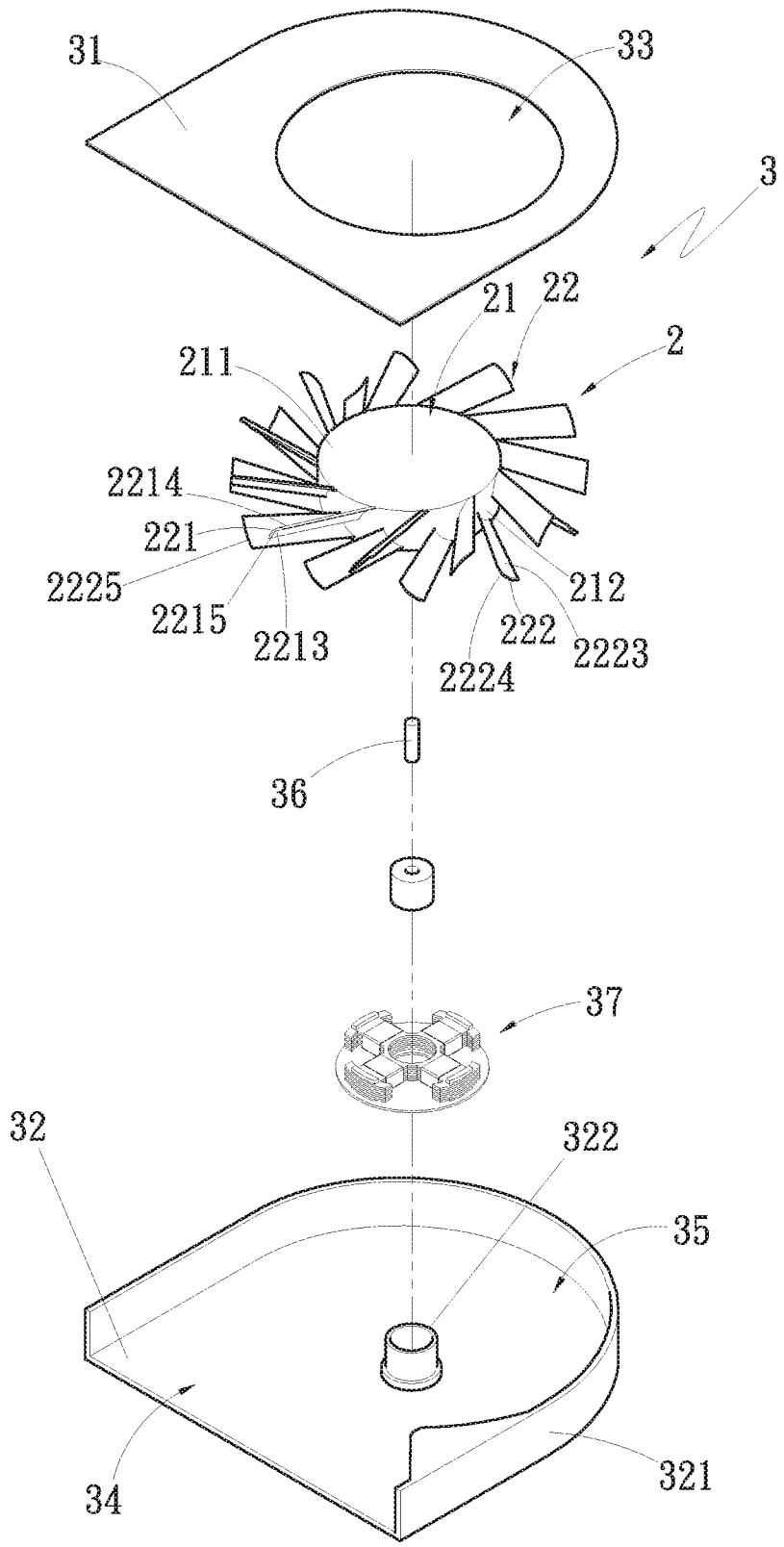
FIG. 3 is a perspective exploded view of a second embodiment of the centrifugal fan of the present invention.
Figure 4A:
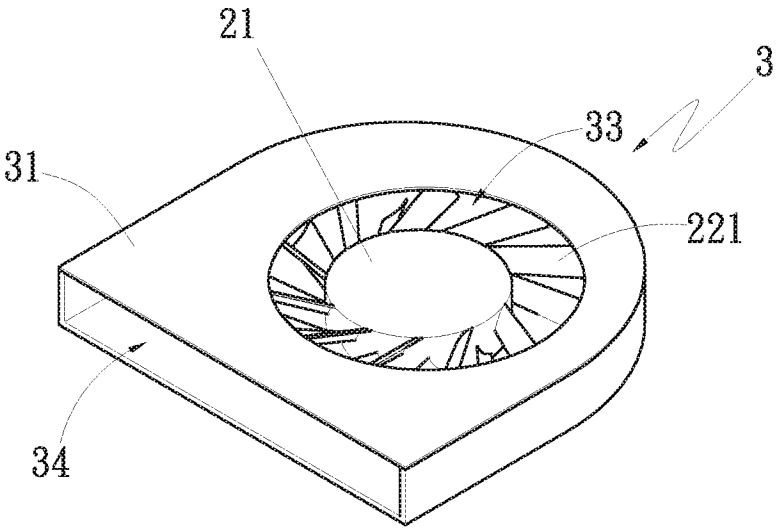
FIG. 4A is a perspective assembled view of the second embodiment of the centrifugal fan of the present invention.
Figure 4B:
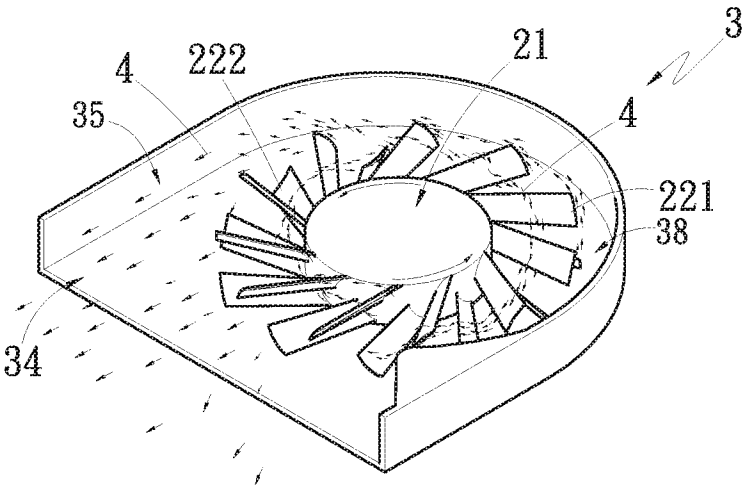
FIG. 4B is a perspective view of the second embodiment of the centrifugal fan of the present invention, showing the pattern of the airflow between the multiple upper and lower blades.
Figure 5:
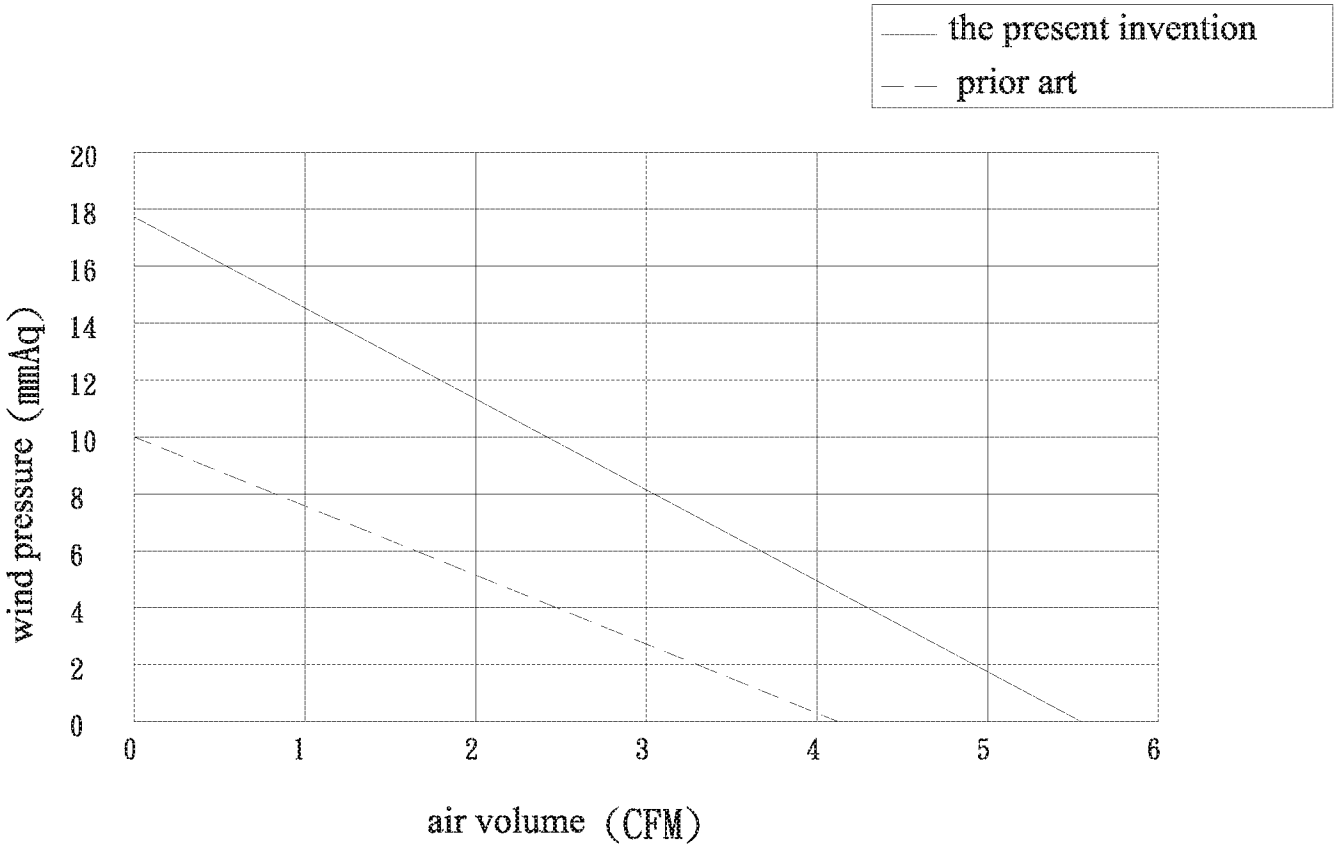
FIG. 5 is a comparison curve diagram of real test of the fan impeller structure of the present invention and the conventional centrifugal fan.

Please now refer to FIGS. 3, 4A, 4B and 5. FIG. 3 is a perspective exploded view of a second embodiment of the centrifugal fan of the present invention. FIG. 4A is a perspective assembled view of the second embodiment of the centrifugal fan of the present invention. FIG. 4B is a perspective view of the second embodiment of the centrifugal fan of the present invention, showing the pattern of the airflow between the multiple upper and lower blades. FIG. 5 is a comparison curve diagram of real test of the fan impeller structure of the present invention and the conventional centrifugal fan. Also referring to FIGS. 2A and 2C, in the second embodiment, the first embodiment of the fan impeller structure 2 of the present invention is applied to a fan 3 (such as a centrifugal fan or a blower). In this embodiment, the fan impeller structure 2 is mounted in the fan 3 (such as a centrifugal fan) for driving the airflow 4. The fan 3 includes a base seat 32 and an upper board 31. The upper board 31 has a wind inlet 33 for the external airflow 4 (fluid) to flow into the fan 3. The upper board 31 is mated with the base seat 32 to form a fan frame. The upper board 31 and the base seat 32 together define a receiving space 35 for receiving the fan impeller structure 2. One end of a shaft 36 is affixed to the hub 21. The other end of the shaft 36 is rotatably disposed in a bearing cup 322 protruding from the base seat 32. The base seat 32 is formed with a wind outlet 34 and a peripheral wall 321 extending along the outer periphery of the base seat 32 and upward protruding from the base seat 32. The wind outlet 34 is disposed on one side of the base seat 32 in communication with the receiving space 35. In addition, outer ends 2215, 2225 of the multiple upper and lower blades 221, 222 in the receiving space 35 and an inner surface of the peripheral wall 321 define an airflow passage 38 therebetween in communication with the wind outlet 34. In practice, a magnetic member (not shown) is disposed on an inner side of the hub 21 of the fan impeller structure 2 to induce and magnetize with a stator 37 fitted around the bearing cup 322.

Please refer to FIGS. 2A, 4B and 5. When the fan impeller structure 2 of the fan 3 counterclockwise rotates, the external airflow 4 is guided through the wind inlet 33 into the receiving space 35. The airflow 4 is guided in by the first front edges 2211 of the multiple upper blades 221. Thereafter, the multiple upper blades 221 will pressurize the airflow 4 to flow out from the first rear edges 2212. Then, the second front edges 2221 of the lower blades 222 on the rear lower side will catch the pressurized airflow 4 thrown from the upper blades 221. Therefore, most of the airflow 4 is continuously up and down pressurized between the upper and lower blades 221, 222 (as shown in FIG. 4B). Thereafter, the airflow around the outer ends 2215, 2225 of the multiple upper and lower blades 221, 222 leaves the pressurization range to be pushed out and flow out of the radial wind outlet 34 (to low pressure) along the inner surface of the peripheral wall 321. At the same time, little airflow 4 in the airflow passage 38 also flows out of the wind outlet 34 along the inner surface of the peripheral wall 321. FIG. 5 is a comparison curve diagram of real test of the fan impeller structure 2 of the present invention and the fan impeller structure 15 of the conventional centrifugal fan. In the diagram, the transverse coordinate (CFM) means the air volume, while the longitudinal coordinate (mmAg) means the wind pressure (static pressure). The present invention is shown by the solid line, while the conventional fan impeller structure is shown by the phantom line. According to the test result, in the precondition that the size and proportion are identical and the same fan frame is used, in the same air volume, the fan 3 of the present invention has higher wind pressure than the conventional centrifugal fan. Also, in the same wind pressure, the present invention has greater air volume. It can be known from the test that the fan 3 of the present invention can truly effectively enhance the performance of the fan 3 and lower the noise.

By means of the design of the fan 3 of the present invention, the airflow 4 (fluid) is continuously pressurized within the range between the multiple upper and lower blades 221, 222 to effectively enhance the wind pressure and air volume of the fan 3. Moreover, only little airflow 4 in the airflow passage 38 will flow out to hit the inner surface of the peripheral wall 321. Therefore, in operation, the noise of the entire fan 3 is lowered, the vibration of the fan 3 is reduced and the power consumption of the fan motor is reduced. Moreover, the cost is effectively lowered and it is easy to manufacture the mold. In addition, the direction in which the airflow is pushed by the first and second windward faces 2213, 2223 of the multiple upper and lower blades 221, 222 of the fan impeller structure 2 of the present invention is inclined from (not normal to) the axial airflow entering direction of the wind inlet 33. Therefore, the non-normal flow field is uneasy to scatter.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan impeller structure comprising:

a hub having a top wall and a circumferential wall extending from a circumference of the top wall, the hub rotatable about a central axis; and a blade set having multiple upper blades and multiple lower blades, the upper and lower blades being alternately arranged on the circumferential wall, each upper blade having a first front edge and a first rear edge downward obliquely extending from the first front edge in a lengthwise direction of the upper blade to together define a first windward face, each lower blade having a second front edge and a second rear edge upward obliquely extending from the second front edge in a lengthwise direction of the lower blade to together define a second windward face, the first windward face being disposed in such a direction as to face the second rear edge of the lower blade on a lower side, while the second windward face being disposed in such a direction as to face the first rear edge of the upper blade on an upper side, the upper blades directing air toward the lower blades and the lower blades directing air toward the upper blades as the hub is rotated about the central axis.

2. The fan impeller structure as claimed in claim 1, wherein the circumferential wall has an upper half section and a lower half section, the multiple upper and lower blades being alternately arranged on the upper and lower half sections.

3. The fan impeller structure as claimed in claim 1, wherein the first rear edge downward obliquely extends from the first front edge in the lengthwise direction of the upper blade to together define a first lee face opposite to the first windward face, the second rear edge upward obliquely extending from the second front edge in the lengthwise direction of the lower blade to together define a second lee face opposite to the second windward face, the first and second lee faces being directed in different directions, the first and second windward faces being directed in different directions without facing each other.

4. The fan impeller structure as claimed in claim 1, wherein the first front edge of any of the multiple upper blades is coaxial with or not coaxial with the second rear edge of the lower blade on a front lower side, which faces the upper blade, the first rear edge of any of the multiple upper blades being coaxial with or not coaxial with the second front edge of the corresponding lower blade on a rear lower side.

5. The fan impeller structure as claimed in claim 1, wherein the multiple upper and lower blades are arc shaped.

6. The fan impeller structure as claimed in claim 1, wherein the multiple upper and lower blades and the hub are integrally formed or non-integrally formed.

7. The fan impeller structure as claimed in claim 1, which is applied to a centrifugal fan, the centrifugal fan including a base seat and an upper board having a wind inlet, the upper board being mated with the base seat to together define a receiving space for receiving the fan impeller structure, one end of a shaft being affixed to the hub, the other end of the shaft being rotatably disposed in a bearing cup protruding from the base seat, a wind outlet being disposed on one side of the base seat in communication with the receiving space.

* * * * *